US007681327B2

(12) United States Patent
Koljonen et al.

(10) Patent No.: US 7,681,327 B2
(45) Date of Patent: Mar. 23, 2010

(54) VACUUM BELT CONVEYOR OF A WEB FORMING MACHINE FOR TRANSFERRING A THREADING TAIL

(75) Inventors: Veli-Pekka Koljonen, Kärnä(FI); Matti Lehtonen, Lannevesi (FI)

(73) Assignee: Metso Paper, Inc., Helsinki (FI)

( * ) Notice: Subject to any disclaimer, the term of this patent is extended or adjusted under 35 U.S.C. 154(b) by 615 days.

(21) Appl. No.: 11/552,459

(22) Filed: Oct. 24, 2006

(65) Prior Publication Data

US 2007/0090145 A1 Apr. 26, 2007

(30) Foreign Application Priority Data

Oct. 25, 2005 (FI) ..... 20055572

(51) Int. Cl.
*D06F 58/00* (2006.01)

(52) U.S. Cl. ..... 34/117; 34/120; 226/95; 226/91; 162/193

(58) Field of Classification Search ..... 34/114, 34/115, 116, 120, 122, 117; 226/95, 170, 226/193, 91; 162/193, 118, 255, 286, 199, 162/200, 257, 391
See application file for complete search history.

(56) References Cited

U.S. PATENT DOCUMENTS 4,096,941 A * 6/1978 Tokuno ..... 198/689.1
4,194,661 A * 3/1980 Grant ..... 226/95
4,882,854 A * 11/1989 Wedel et al. ..... 34/115
4,974,340 A * 12/1990 Wedel et al. ..... 34/115
5,135,614 A * 8/1992 Aula et al. ..... 162/217
5,214,861 A * 6/1993 Vuorinen ..... 34/114
5,537,755 A * 7/1996 Kotitschke ..... 34/117
6,797,115 B2 * 9/2004 Klerelid et al. ..... 162/111
2004/0244217 A1 * 12/2004 Ahvenainen et al. ..... 34/114
2005/0230447 A1 * 10/2005 Koljonen et al. ..... 226/95

FOREIGN PATENT DOCUMENTS

EP 1605098 A1 2/2001
EP 1520815 A1 8/2004
FI 20045069 A 9/2005
WO 03018909 A1 3/2003

OTHER PUBLICATIONS

Search Report issued in foreign priority application FI 20055572.
English Translation of EP1520815.

* cited by examiner

*Primary Examiner*—Kenneth B Rinehart
*Assistant Examiner*—Corey Hall
(74) *Attorney, Agent, or Firm*—Stiennon & Stiennon

(57) ABSTRACT

A vacuum belt conveyor of a web forming machine for transferring a threading tail has at least two turning rolls (16, 17) and an air-permeable belt loop (20), arranged around the turning rolls (16, 17). The vacuum belt conveyor also has vacuum means (22) for creating a vacuum effect on both the section of the belt loop (20) conveying the threading tail (23) and in connection with the first turning roll (16) of the turning rolls (16, 17). Arranged in connection with the first turning roll (16) in the travel direction of the threading tail (23) there is at least one cross-directional dividing structure (24) for creating at least two axial vacuum zones (25).

18 Claims, 3 Drawing Sheets

VACUUM BELT CONVEYOR OF A WEB FORMING MACHINE FOR TRANSFERRING A THREADING TAIL

CROSS REFERENCES TO RELATED APPLICATIONS

This application claims priority on Finnish Application No. 20055572, filed Oct. 25, 2005, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a vacuum belt conveyor of a web forming machine for transferring a threading tail, said vacuum belt conveyor comprising at least two turning rolls, an air-permeable belt loop arranged around the turning rolls, and vacuum means for providing a vacuum effect on both the belt loop section conveying the threading tail and in connection with the first one of said turning rolls.

Finnish patent application No. 20045069A discloses a vacuum belt conveyor according to the preamble, which is characterized by having a vacuum effect in connection with the first turning roll. Thus a negative pressure can be used to detach the threading tail from the surface of a dryer cylinder, for example. In the proposed vacuum belt conveyor negative pressure is created at the first turning roll by means of air blasting equipment arranged within the frame construction. Furthermore, a grooved roll is used as the first turning roll, via the grooves of which the vacuum effect is distributed over the entire turning length and essentially to the half of the circumference of the turning roll.

By using a grooved roll it is possible to achieve a relatively uniform distribution of negative pressure over the entire belt loop area contacting the turning roll. In practice, however, the belt loop is decidedly wider than the threading tail. This being the case, negative pressure escapes through the belt loop in the areas without the threading tail. Due to the incomplete coverage, negative pressure tends to balance over the entire turning length, whereby the maximum vacuum effect at the threading tail remains unachieved. In addition, the vacuum effect in the radial direction of the turning roll is essentially the same all over, although the critical positions vary between different applications. In practice, the grooved roll manufacture is also difficult. Furthermore, low and narrow grooves unnecessarily throttle the flow reducing thus the vacuum effect subjected to the threading tail. Regardless of the relatively wide vacuum belt conveyor, the threading tail can pass by at least partially in which case tail threading becomes unsuccessful. At the same time the threading tail may wind up around a dryer cylinder, for example, with disastrous consequences.

SUMMARY OF THE INVENTION

The object of the invention is to provide a new type of vacuum belt conveyor for a web forming machine for transferring the threading tail, said vacuum belt conveyor providing a more efficient, and more precisely adjustable vacuum effect in connection with the first turning roll. The features characterizing this invention become evident from the appended claims. In the vacuum belt conveyor according to the invention, the first turning roll has a new design. In addition, in connection with the turning roll, constructions have been arranged which can ensure generation of a sufficient vacuum effect at the threading tail. Furthermore, the maximum vacuum effect is achieved irrespective of the location of the threading tail. The constructions can also be used to direct the vacuum effect in a smaller area than heretofore. In this way the vacuum effect can be directed to critical points, which further improves the likelihood of successful tail threading. In addition, the threading tail can be gained in control in case it should track off from the vacuum belt conveyor. The vacuum belt conveyor according to the invention can also be located more freely in different positions and it can be connected to other tail threading devices. At the same time it is possible to avoid any pass-through of the threading tail and the problems related thereto.

The invention is described below in detail by making reference to the enclosed drawings, which illustrate some of the embodiments of the invention.

DESCRIPTION OF THE PREFERRED EMBODIMENTS

Figures 1, 4:
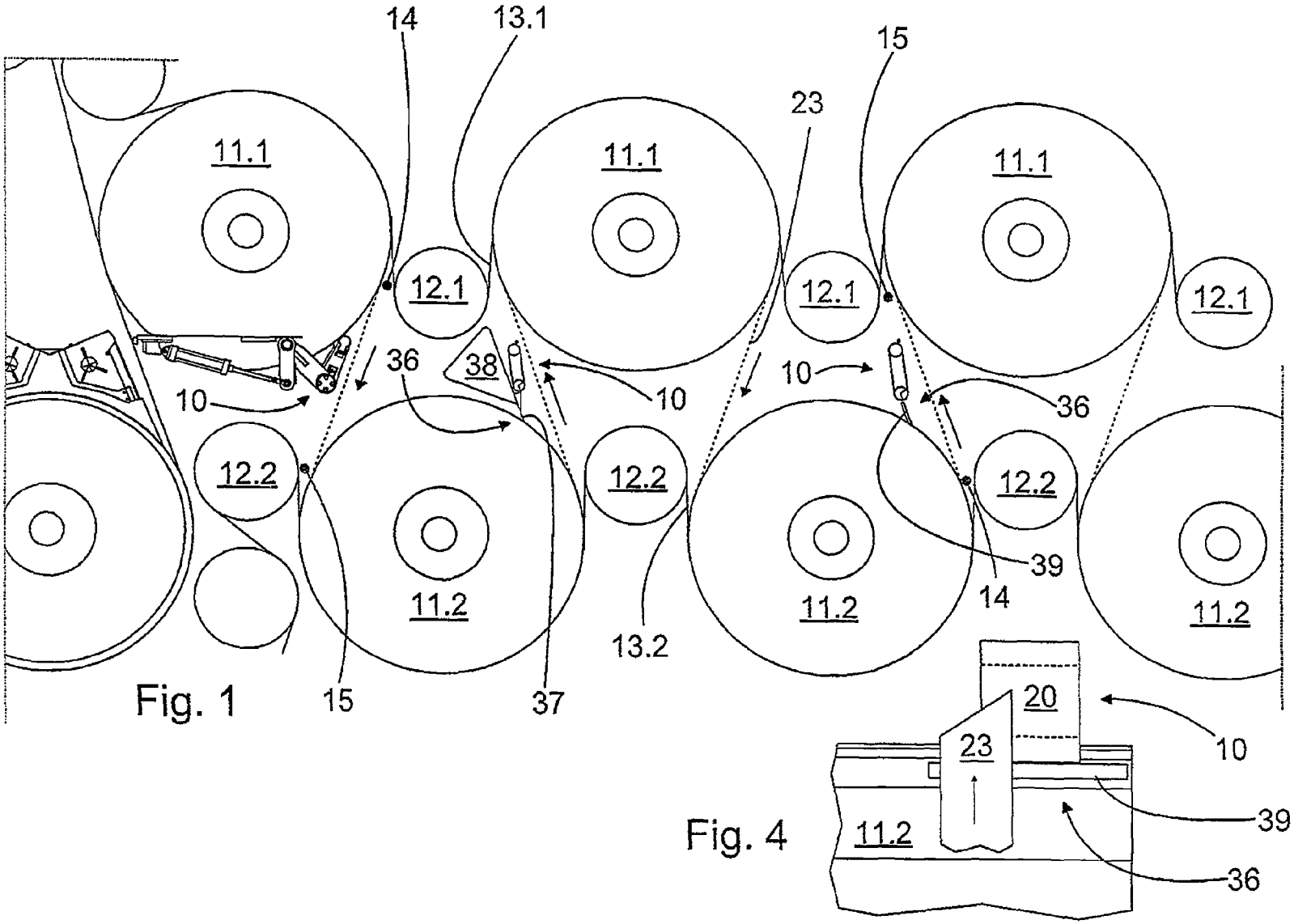
FIG. 1 is a lateral view of a part of the dryer section of a web forming machine equipped with vacuum belt conveyors according to the invention.
FIG. 4 shows a third embodiment of the vacuum belt conveyor according to the invention.

FIG. 1 illustrates three vacuum belt conveyors 10 according to the invention for taking the threading tail over the open draw in a twin-wire dryer section. The vacuum belt conveyor according to the invention is used particularly for transferring and guiding the threading tail in paper, board and other similar web forming machines. For simplification, the vacuum belt conveyors 10 are later referred to as conveyors, which are shown in the operating positions in FIG. 1. During the normal dryer section operation the conveyors according to the invention can be turned to the rest position. In a known way, the dryer cylinders 11.1 and 11.2 belonging to the dryer section have been arranged in two levels. However, the dryer section frame constructions and the dryer cylinder bearing assemblies are not shown in the figures. In addition, arranged on each level between the dryer cylinders 11.1 and 11.2 there are auxiliary rolls 12.1 and 12.2, which are used to guide the fabrics 13.1 and 13.2 to travel via the successive dryer cylinders 11.1 and 11.2 of the level. However, during the operation the web travels alternately from one level to another. In this case, when starting the production, the threading tail 23, shown in FIG. 2, must first be transferred from the opening gap 14 of one level over the open draw to the closing gap 15 of the other level. The threading tail 23 located in the open draw is illustrated with a broken line in FIG. 1. Each gap is created in each case between the dryer cylinder and the fabric of the same level. For successful tail threading, a conveyor or some other tail threading device must be arranged in each open draw, although FIG. 1 shows only a part of the conveyors 10, to provide an example.

Figure 2:
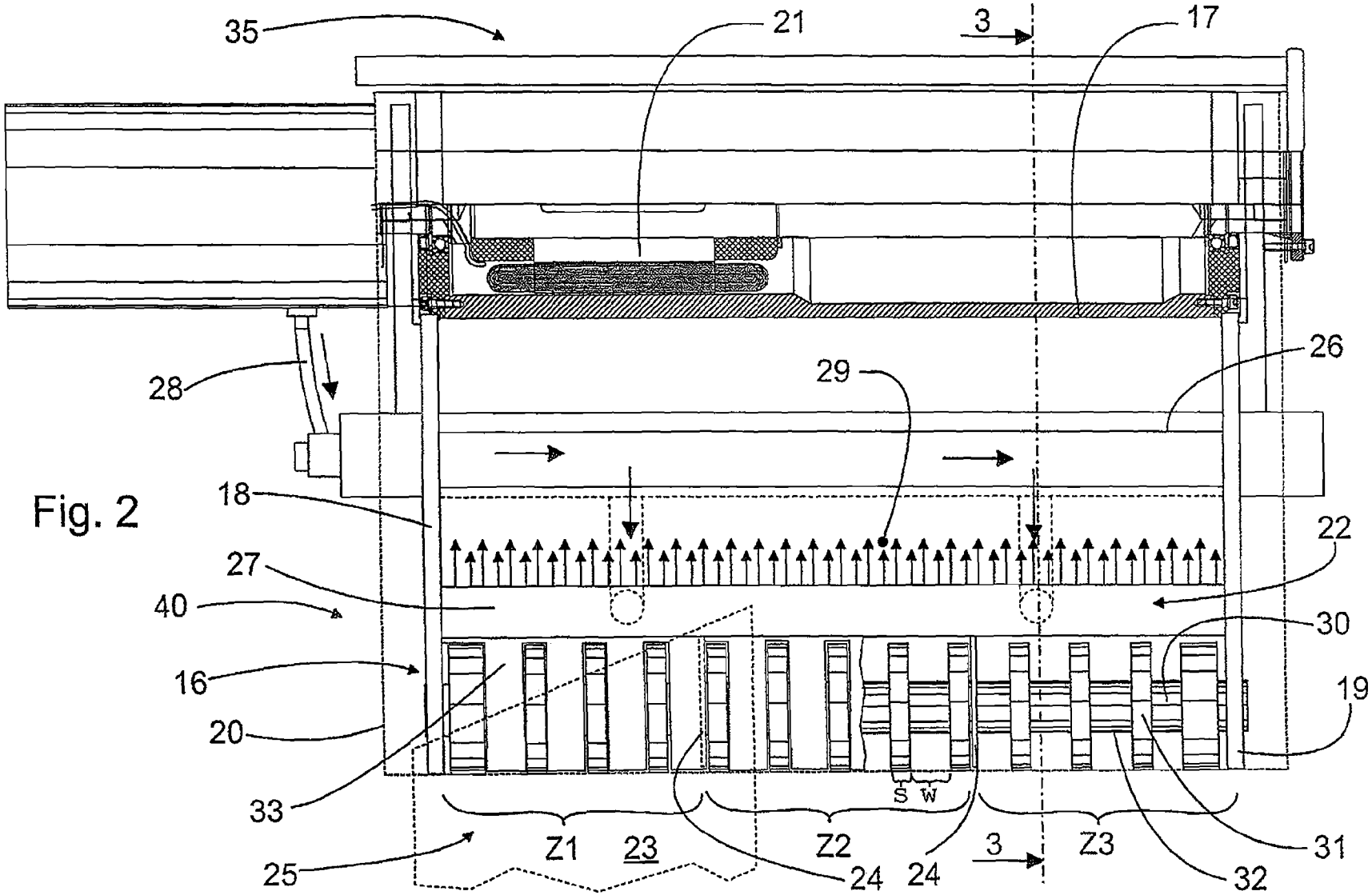
FIG. 2 is a top view and a partial profile view of the vacuum belt conveyor according to the invention.
Figure 3:
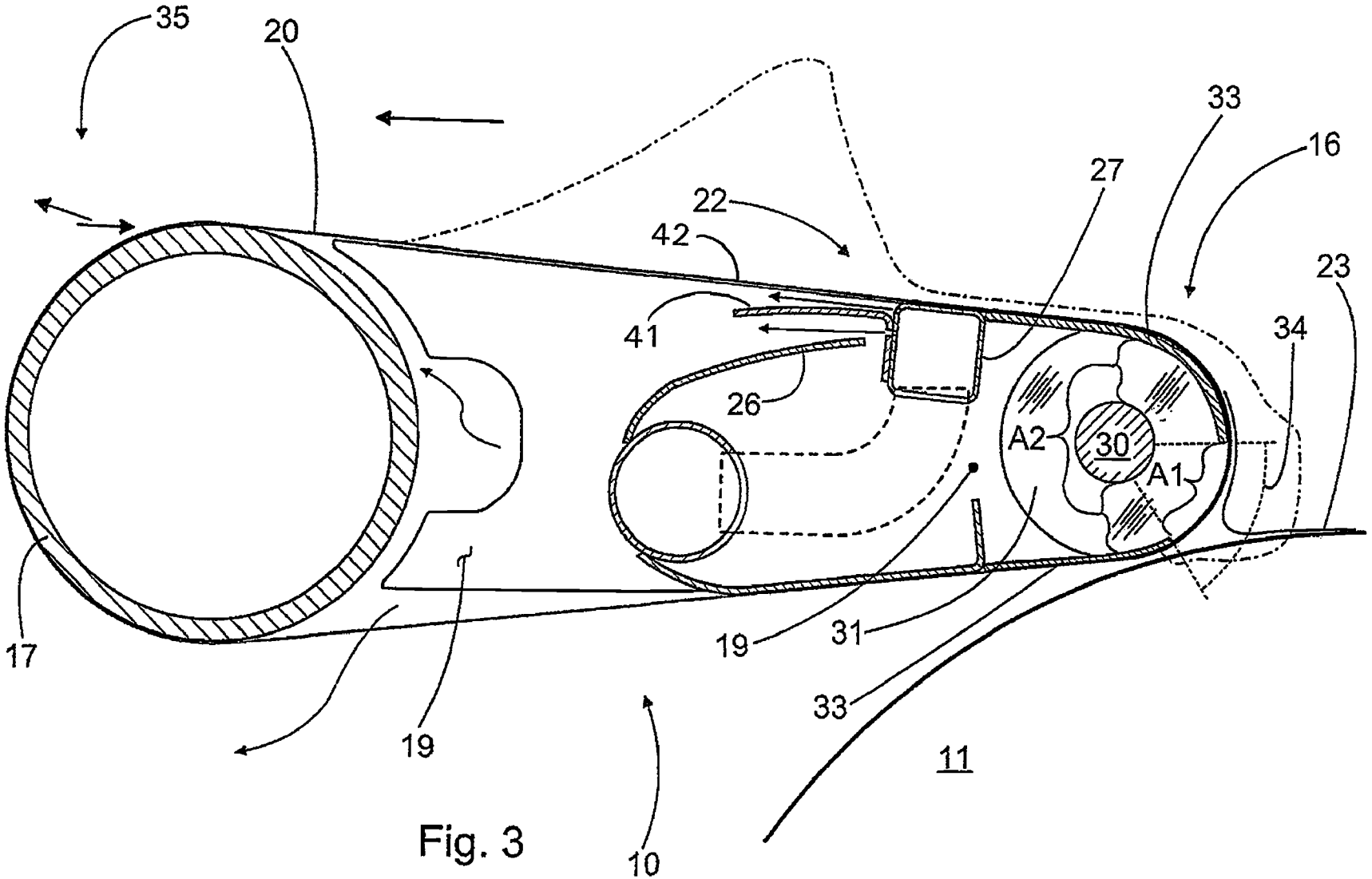
FIG. 3 is a cross-sectional view taken along section line 3-3 of FIG. 2.

As shown in FIG. 3, the conveyor according to the invention comprises at least two turning rolls 16 and 17, which are supported to a frame construction 40, shown in FIG. 2. The frame construction 40 is composed of side plates 18 and 19, which are supported to each other with suitable transverse constructions. The conveyor 10 also comprises a belt loop 20, arranged around the turning rolls 16 and 17. In practice, the belt loop 20 is usually an air-permeable fabric. The belt loop 20 is also arranged to rotate in the travel direction of the threading tail 23 supported by the turning rolls 16 and 17. In the proposed embodiment, the drive motor 21 rotating the belt loop 20 is located inside the larger turning roll 17. The conveyor additionally comprises vacuum means 22 for creating a vacuum effect for both the section of the belt loop 20 conveying the threading tail 23 and in connection with the first turning roll 16 of the turning rolls 16, 17. In this way the threading tail 23 can be detached, as shown in FIG. 3, from the surface of the dryer cylinder 11 and simultaneously transferred further transported by the belt loop 20. The belt loop 20 is detached from the dryer cylinder 11 surface, and for detaching the threading tail 23 the mere vacuum effect is used here.

To avoid the drawbacks of the prior art technique, according to the invention, arranged in connection with the first turning roll 16 in the travel direction of the threading tail 23 there is at least one cross-directional dividing structure 24, shown in FIG. 2, for creating at least two axial vacuum zones 25. In FIG. 2 the dividing structures 24 are two in number, in which case three vacuum zones Z1, Z2 and Z3 are created for the first turning roll 16. The dividing structure is arranged in such a manner that the negative pressure levels of adjacent vacuum zones are independent of each other. At the same time it is possible to prevent the vacuum effect from escaping for example in a situation when the threading tail covers only a part of the belt loop. In the example situation of FIG. 2, the threading tail 23 arrives at the conveyor 10 slightly tracked off. In this case the threading tail 23 covers completely the left-hand side vacuum zone Z1, which then rises to the maximum vacuum effect without negative pressure escaping through the other vacuum zones Z2 or Z3. The center-most vacuum zone Z2 also rises to a vacuum effect of a certain degree. In practice, the rotating movement of the belt loop, for example, also tends to center the threading tail to the center of the conveyor, in which case it is the center-most vacuum zone that in turn rises to the maximum vacuum effect when the threading tail covers this vacuum zone completely. Thus an air blow with the same volume size as before provides a vacuum effect that is more intensive than heretofore. On the other hand, to achieve the same vacuum effect, an air blow with a volume smaller than before can be used.

The conveyor according to the invention has two to six vacuum zones, more advantageously three to four. Thus it can be ensured that at least one of the vacuum zones has the maximum vacuum effect during tail threading when the threading tail is wider than the vacuum zone. The design of the conveyor can be simplified by restricting the number of vacuum zones. The same can be achieved by adjusting the vacuum zones essentially to the same size with each other. This also ensures the centering effect of the vacuum zones towards the threading tail.

In the conveyor 10 shown in FIGS. 2 and 3, negative pressure applied to the first turning roll 16 is generated inside the belt loop 20. Here the negative pressure is thus created with a deflector 26, to which compressed air is led with a distributor pipe 27. According to FIG. 2, the distributor pipe 27 is connected to a compressed air connection 28 comprised in the conveyor. The vacuum effect in connection with the first turning roll 16 is created by means of a vacuum chamber 29 arranged within the belt loop 20, in which chamber negative pressure is arranged using the above mentioned deflector 26 where the distributor pipe 27 is arranged to blow air over the deflector to form a source of vacuum which extends in the axial direction across the vacuum chamber. The distributor pipe 27 is arranged to blow air over a second deflector 41 mounted beneath the air-permeable belt loop 20 to create a further vacuum zone on a section 42 of the belt loop overlying the second deflector plate. A grooved roll is advantageously used as the first turning roll in the conveyor whereby negative pressure extends from the vacuum chamber via the grooved roll grooves to the belt loop providing in this way a force required for detaching the threading tail. According to the invention, the grooved roll is composed of a shaft 30 and disc-like necks 31 arranged thereon at a certain interval between each other. The shaft 30 including the necks 31 can be manufactured by turning, using a thick bar material. On the other hand, it is possible to simply fasten separately machined discs on a thin shaft. In this case it is also possible to alter the distance between the discs, if required, and discs of different sizes can be arranged on one type of a shaft depending on the application. According to the invention, however, grooves that are notably larger and deeper than known are used in the grooved roll. In this way it is possible to provide a more open grooved roll than heretofore, which facilitates the distribution and extension of negative pressure through the belt loop until to the threading tail. According to the invention, the widths of neck 31 is 5-20, more advantageously 10-15 mm. Correspondingly, the distance w between two adjacent necks 31 is 1-5, more advantageously 2-4 times the width s of neck 31. In this case a major part of the grooved roll is open while the necks still support the belt loop sufficiently.

Other advantages can also be achieved with wide and deep grooves. According to the invention, as shown in FIG. 2, at least one profiled restrictor plate 33 has surprisingly been arranged in the groove 32 comprised in the grooved roll for restricting the vacuum effect to a partial section of the circumference of the first turning roll 16. In other words, the vacuum effect can be directed in a location where it is needed the most. FIG. 2 shows one restrictor plate 33 for illustrating only partly the construction of the grooved roll. In practice, the restrictor plate 33 is arranged as a part of the frame construction 40 of the vacuum belt conveyor, and its shape corresponds essentially to the shape of the first turning roll 16. With suitable clearances, the restrictor plate does not disturb the rotation of the grooved roll. In addition, negative pressure affecting between the necks and the restrictor plate is also directed to the belt loop to some extent, whereby the threading tail that is once detached from the dryer cylinder remains attached to the belt loop until to the delivery point.

In the embodiment of FIG. 3 there are in fact two restrictor plates 33, which, being located on each side of the grooved roll, also make a part of the conveyor's frame construction 40. By modifying the dimensions of the restrictor plates the vacuum effect can be simply directed to a desired point in the circumference of the grooved roll. Generally the restrictor plate 33 and the frame construction 40 or two restrictor plates 33 adapted to face each other are so arranged that they restrict a vacuum sector 34. One vacuum sector 34 is shown in FIG. 3. FIG. 1 also depicts a principle of vacuum sectors 34 in connection with two right-hand side conveyors 10. In these embodiments the vacuum sector 34 is located on the other side of the top dead center of the grooved roll compared to what is shown in FIG. 3. In other words, in FIG. 3 the vacuum sector ends at the top dead center of the grooved roll in the travel direction of the belt loop, whereas in FIG. 1 the vacuum sector starts after the top dead center. Here the term 'top dead center' refers to the most external point of the grooved roll relative to the frame construction. Depending on the application, the vacuum sector can thus be located in different positions. The size of the vacuum sector is also significant for the conveyor operation. Advantageously the flow cross-sectional area A1 of the vacuum sector 34 is essentially as large as the flow cross-sectional area A2 restricted by the first grooved roll 16 and the frame construction 40 in the groove 32 (FIG. 3). In this case, an attempt is made to provide for the negative pressure a flow route as lossless as possible from the deflector to the belt loop. The level of negative pressure achievable reduces when the vacuum sector is increased. Correspondingly, when the vacuum sector is reduced, the flow inside the belt loop is throttled, which again reduces the achievable negative pressure level compared to the optimum situation described above.

FIG. 3 shows the principle of negative pressure volume with a dot-and-dash line. Due to the vacuum sector 34 according to the invention the most efficient vacuum effect is exactly at the point in which the threading tail 23 is detached from the dryer cylinder 11 surface. Prior to the detachment point, some flow can access from between the restrictor plate 33 and the necks 31, which provides a relatively small vacuum effect. Once the vacuum sector 34 has opened, the vacuum effect quickly rises to its maximum value reducing gradually, but keeping, however, the threading tail 23 in control all the time. Even overpressure can be present near the second turning roll 17 whereby the threading tail 23 easily detaches from the belt loop. The detachment of the threading tail 23 can be ensured with air doctors 35, arranged in connection with the second turning roll 17 (FIG. 2). FIG. 3 shows the blow directions of these air doctors 35 only. The first blow makes the threading tail detach from the surface of the belt loop while the second blow guides the tail further. However, often a mere bar adapted in place of the air distributor pipe is sufficient, which dams up the boundary-layer air of the belt loop separating in this way the threading tail from the belt loop.

According to the application examples, the conveyor is advantageously used in the twin-wire dryer section of a web forming machine or in another application, in which the threading tail is picked up from a cylinder or roll and transported over an open draw. In the proposed embodiment the threading tail must be detached from the dryer cylinder surface and transported to the following closing gap. According to the invention, a doctoring element 36 has been arranged prior to the first turning roll 16 in the travel direction of the threading tail 23 for detaching the threading tail 23 from the surface of the dryer cylinder 11.1, 11.2. In other words, the doctoring element is used to ensure the detachment of the threading tail. According to the invention, the design of the doctoring elements can vary. In the first embodiment the doctoring element 36 is a doctor blade 37, as shown in FIG. 1, extending essentially over the entire width of the web forming machine, bracketed with a doctor beam 38 to which the conveyor 10 is supported. This type of conveyor 10 is shown in FIG. 1 at the center. In practice, this position often has a doctor blade with doctor beams, but the threading tail is guided with air blows, which often have insufficient intensity. In other words, making the threading tail enter to an above-located closing gap is unreliable. By locating a conveyor according to the invention in this doctoring equipment, it is possible to further increase the likelihood of successful tail threading.

Likewise, in positions lacking a full-length doctor blade with doctor beams, the second embodiment according to the invention can be used. Alternatively, as shown in FIG. 4, the doctoring element 36 can thus be a doctor blade 39 essentially shorter than the width of the web forming machine, supported to the vacuum belt conveyor. In addition the doctor blade 39 is arranged in the designed area of the threading tail in the width direction of the web forming machine, and the length of the doctor blade 39 is at least two times the width of the vacuum belt conveyor. In addition, the doctor blade extends outside the conveyor on both sides. This ensures the detachment of the threading tail from the dryer cylinder surface. On the other hand, it is possible at the same time to avoid problem situations, in which the threading tail for some reason completely or partly passes by the conveyor. The threading tail can be reliably detached with even a short, but a suitably located doctor blade. In addition, the detached threading tail is guided to the center of the conveyor particularly if using the above described vacuum zones and sectors. The embodiment of a short doctor blade is shown in FIG. 1 as the right-hand side embodiment, which is depicted in FIG. 4 as seen from the machine direction.

The vacuum belt conveyor according to the invention is more efficient and reliable than heretofore. In addition, it can be arranged in various positions and its construction is modifiable. Particularly by utilizing the vacuum zones and sectors, a more efficient vacuum effect than heretofore can be directed to an area smaller, but more accurately definable than before, in both the travel direction and the cross-direction of the threading tail.

We claim:

1. A vacuum belt conveyor of a web forming machine for transferring a threading tail, said vacuum belt conveyor comprising:

an air-permeable belt loop;

a frame, comprising two side plates;

a first turning roll mounted to the frame between the two side plates, and having an axis defining an axial direction and a circumference defining a circumferential direction;

a second turning roll mounted to the frame, and spaced from the first turning roll;

wherein the first turning roll and the second turning roll are positioned within the belt loop and arranged so that the belt loop travels over the first turning roll and the second turning roll;

wherein the first turning roll has portions defining an axial shaft with circular disc shaped necks thereon, the necks defining circumferential grooves therebetween;

a vacuum chamber formed between the two side plates and containing the first turning roll, the vacuum chamber having a deflector forming part of the vacuum chamber, and a distributor pipe connected to a source of compressed air, the distributor pipe arranged to blow air over the deflector to form a source of vacuum which extends in the axial direction across the vacuum chamber which creates a vacuum effect in the vacuum chamber;

at least one cross-directional dividing structure arranged to divide the vacuum chamber and the first turning roll to create at least a first vacuum zone and a second vacuum zone spaced in the axial direction along the first turning roll from the first vacuum zone, the source of vacuum arranged to create a vacuum effect in said first vacuum zone and said second vacuum zone; and wherein the distributor pipe is arranged to blow air over a second deflector mounted beneath the air-permeable belt loop to create a further vacuum zone on a section of the belt loop overlying the second deflector plate.

2. The vacuum belt conveyor of claim 1, wherein the at least one cross directional dividing structure comprises a plurality of cross-directional. dividing structures arranged to create a plurality of axially spaced vacuum zones in the axial direction along the first turning roll, and wherein the source of vacuum is arranged to create a vacuum effect in each vacuum zone.

3. The vacuum belt conveyor of claim 2 wherein the vacuum zones have essentially the same axial extent.

4. The vacuum belt conveyor of claim 1, wherein the necks have an axial width of between 5 mm to 20 mm.

5. The vacuum belt conveyor of claim 4, wherein the circumferential grooves extend axially between adjacent necks 1-5 times the axial width of the necks.

6. The vacuum belt conveyor of claim 1, further comprising at least one restrictor plate which is profiled so that portions of the restrictor plate are arranged in the circumferential grooves and define a restricted circumferential vacuum sector such that vacuum is intensified in a restricted circumferential portion of the air-permeable belt loop on the circumference of the first roll.

7. The vacuum belt conveyor of claim 6, wherein the restrictor plate is arranged as a part of the frame construction and has a portion shaped to essentially correspond to the circumference of the first turning roll.

8. The vacuum belt conveyor of claim 7, wherein the restrictor plate and the frame or a second restrictor plate are arranged to face each other so that they restrict the vacuum sector to a selected flow cross-sectional area.

9. The vacuum belt conveyor of claim 8, wherein a passageway connecting the vacuum effect to the vacuum sector is defined by the circumferential grooves and has a cross-sectional area which is essentially as large as the selected flow cross-sectional area.

10. The vacuum belt conveyor of claim 1 further comprising:

a doctor beam to which the vacuum belt conveyor is mounted, and a doctoring element mounted to the doctor beam to detach the threading tail from a surface, and to direct a web tail to the vacuum belt conveyor.

11. A vacuum belt conveyor of a web forming machine for transferring a threading tail, said vacuum belt conveyor comprising:

an air-permeable belt loop;

a frame, comprising two side plates;

a first turning roll mounted to the frame, and having an axis defining an axial direction and a circumference defining a circumferential direction;

a second turning roll mounted to the frame, and spaced from the first turning roll, wherein the first turning roll and the second turning roll are positioned within the belt loop and arranged so that the belt loop travels over the first turning roll and the second turning roll;

wherein the first turning roll has portions defining an axial shaft with circular disc shaped necks thereon, the necks defining circumferential grooves therebetween;

a vacuum chamber formed between the two side plates and containing the first turning roll, the vacuum chamber having a deflector forming part of the vacuum chamber, and a distributor pipe connected to a source of compressed air, the distributor pipe arranged to blow air over the deflector to form a source of vacuum which extends in the axial direction across the vacuum chamber which creates a vacuum effect in the vacuum chamber;

at least one cross-directional dividing structure arranged to divide the vacuum chamber and the first turning roll to create at least a first vacuum zone connected to the source of vacuum and a second vacuum zone spaced in the axial direction along the first turning roll from the first vacuum zone and connected to the source of vacuum, the at least one cross-directional dividing structure being arranged in such a manner that the negative pressure levels of adjacent vacuum zones are independent of each other.

12. The vacuum belt conveyor of claim 11, further comprising a plurality of cross-directional dividing structures arranged to create a plurality of axially spaced vacuum zones in the axial direction along the first turning roll, and wherein each vacuum zone is independent of every other vacuum zone.

13. The vacuum belt conveyor of claim 12, wherein the vacuum zones have essentially the same axial extent.

14. The vacuum belt conveyor of claim 11, further comprising at least one restrictor plate which is profiled so that portions of the restrictor plate are arranged in the circumferential grooves and define a restricted circumferential vacuum sector such that vacuum is intensified in a restricted circumferential portion of the air-permeable belt loop on the circumference of the first roll.

15. A twin-wire dryer section in a web forming machine of a selected width comprising:

a first plurality of dryer cylinders arranged at a first level, and comprised of first successive dryer cylinders, and having first turning rolls between the first successive dryer cylinders arranged to guide a first fabric through the first successive dryer cylinders, the first fabric forming first opening gaps where the fabric leaves one of the first successive dryer cylinders, and forming first closing gaps where the fabric joins one of the first successive dryer cylinders;

a second plurality of dryer cylinders arranged at a second level, and comprised of second successive dryer cylinders, and having second turning rolls between the successive dryer cylinders arranged to guide a second fabric through the second successive dryer cylinders, the second fabric forming second opening gaps where the fabric leaves one of the second successive dryer cylinders, and forming second closing gaps where the fabric joins one of the second successive dryer cylinders;

a vacuum belt conveyor comprising: an air-permeable belt loop of a selected width; a frame, comprising two side plates; a first turning roll mounted to the frame, the first turning roll having an axis defining an axial direction and a circumference defining a circumferential direction; a second turning roll mounted to the frame, and spaced from the first turning roll, wherein the first turning roll and the second turning roll are positioned within the belt loop and arranged so that the belt loop travels over the first turning roll and the second turning roll;

wherein the first turning roll has portions defining an axial shaft with circular disc shaped necks thereon, the necks defining circumferential grooves therebetween;

a vacuum chamber formed between the two side plates and containing the first turning roll, the vacuum chamber having a deflector forming part of the vacuum chamber, and a distributor pipe connected to a source of compressed air, the distributor pipe arranged to blow air over the deflector to form a source of vacuum which extends in the axial direction across the vacuum chamber which creates a vacuum effect in the vacuum chamber;

at least one cross-directional dividing structure arranged to divide the vacuum chamber and the first turning roll to create at least a first vacuum zone and a second vacuum zone spaced in the axial direction along the first turning roll from the first vacuum zone, the source of vacuum arranged to create a vacuum effect in said first vacuum zone and said second vacuum zone; and wherein the distributor pipe is arranged to blow air over a second deflector mounted beneath the air-permeable belt loop to create a further vacuum zone on a section of the belt loop overlying the second deflector plate;

wherein the vacuum belt conveyor is arranged between the first level of the first successive dryer cylinders and the second level of second successive dryer cylinders, and is arranged to transfer a threading tail from a first opening gap over an open draw to a second closing gap; and a doctoring element arranged to detach the threading tail from the surface of one of the dryer cylinders of the first plurality of dryer cylinders prior to the first turning roll.

16. The twin-wire dryer section of claim 15, wherein the doctoring element is a doctor blade extending essentially over the entire selected width of the web forming machine which is supported on a bracket to a doctor beam on which the vacuum belt conveyor is supported.

17. The vacuum belt conveyor of claim 15, wherein the doctoring element is a doctor blade shorter than the selected width of the web forming machine, supported on a bracket to a doctor beam on which the vacuum belt conveyor is supported.

18. The vacuum belt conveyor of claim 15, wherein the doctor blade has a width which is at least two times the width of the vacuum belt conveyor loop and extends on both sides of the vacuum belt conveyor.

* * * * *